US011484171B2

(12) United States Patent
Bloom et al.

(10) Patent No.: US 11,484,171 B2
(45) Date of Patent: Nov. 1, 2022

(54) SEPARATOR CONFIGURATION FOR A FLOOR CLEANER

(71) Applicant: Techtronic Cordless GP, Anderson, SC (US)

(72) Inventors: Michael Bloom, Charlotte, NC (US); Rafael Davila, Kannapolis, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 184 days.

(21) Appl. No.: 17/083,936

(22) Filed: Oct. 29, 2020

(65) Prior Publication Data

US 2021/0127933 A1 May 6, 2021

Related U.S. Application Data

(60) Provisional application No. 62/928,673, filed on Oct. 31, 2019.

(51) Int. Cl.
*A47L 11/40* (2006.01)
*A47L 11/30* (2006.01)

(52) U.S. Cl.
CPC ..... *A47L 11/4016* (2013.01); *A47L 11/30* (2013.01); *A47L 11/4083* (2013.01)

(58) Field of Classification Search
CPC .. A47L 11/4016; A47L 11/30; A47L 11/4083; A47L 7/0004; A47L 11/201
See application file for complete search history.

(56) References Cited

U.S. PATENT DOCUMENTS 5,493,752 A 2/1996 Crouser et al.
5,500,977 A 3/1996 McAllise et al.
5,615,448 A 4/1997 Crouser et al.
5,761,763 A 6/1998 McAllise et al.
5,779,744 A 7/1998 Mueller et al.
5,867,861 A 2/1999 Kasen et al.
5,896,617 A 4/1999 Kasen et al.
(Continued)

FOREIGN PATENT DOCUMENTS

DE 202016104991 U1 12/2016
GB 2415362 A 12/2005

OTHER PUBLICATIONS

International Search Report and Written Opinion for Application No. PCT/US2020/057928 dated Feb. 23, 2021 (13 pages).

*Primary Examiner* — David Redding
(74) *Attorney, Agent, or Firm* — Michael Best & Friedrich LLP

(57) ABSTRACT

A cleaning machine has a housing, a supply tank, a suction nozzle, a suction source, and a recovery tank that includes a container having sidewalls projecting upwardly from a bottom wall thereby defining an open top, a cover connected to the open top of the container, and an air-liquid separator extending into the recovery tank from the open top and having a vertical sidewall, a lower wall extending laterally from a lower end of the vertical sidewall toward an adjacent sidewall of the sidewalls of the container. The vertical sidewall, the lower wall, and the adjacent sidewall define a separation chamber, the vertical sidewall includes a vertical rib extending outwardly from the vertical sidewall and into the separation chamber. The separation chamber includes a dirty fluid inlet receiving fluid from the suction nozzle through the cover, and a dirty fluid outlet directing fluid from the separation chamber into the container.

20 Claims, 8 Drawing Sheets

(56) References Cited

U.S. PATENT DOCUMENTS

| | | | |
|---|---|---|---|
| 5,901,406 | A | 5/1999 | Mueller et al. |
| 5,937,475 | A | 8/1999 | Kasen et al. |
| 6,041,472 | A | 3/2000 | Kasen et al. |
| 6,073,300 | A | 6/2000 | Zahuranec et al. |
| 6,081,962 | A | 7/2000 | Kasen et al. |
| 6,131,237 | A | 10/2000 | Kasper et al. |
| 6,134,744 | A | 10/2000 | Kasen et al. |
| 6,138,322 | A | 10/2000 | Crouser et al. |
| 6,158,081 | A | 12/2000 | Kasen et al. |
| 6,167,586 | B1 | 1/2001 | Reed, Jr. et al. |
| 6,167,587 | B1 | 1/2001 | Kasper et al. |
| 6,192,548 | B1 | 2/2001 | Huffman |
| 6,192,549 | B1 | 2/2001 | Kasen et al. |
| 6,230,362 | B1 | 5/2001 | Kasper et al. |
| 6,279,196 | B2 | 8/2001 | Kasen et al. |
| 6,286,180 | B1 | 9/2001 | Kasper et al. |
| 6,286,181 | B1 | 9/2001 | Kasper et al. |
| 6,363,570 | B2 | 4/2002 | Kasper et al. |
| 6,368,373 | B1 | 4/2002 | Mueller |
| 6,401,294 | B2 | 6/2002 | Kasper |
| 6,412,141 | B2 | 7/2002 | Kasper et al. |
| 6,438,793 | B1 | 8/2002 | Miner et al. |
| 6,609,269 | B2 | 8/2003 | Kasper |
| 6,725,498 | B2 | 4/2004 | Symensma et al. |
| 6,898,820 | B2 | 5/2005 | Kasper et al. |
| 7,039,985 | B2 | 5/2006 | Hisrich et al. |
| 7,048,783 | B2 | 5/2006 | Ponjican et al. |
| 7,048,804 | B2 | 5/2006 | Kisela et al. |
| RE39,304 | E | 9/2006 | Kasen et al. |
| 7,331,082 | B2 | 2/2008 | Hertrick et al. |
| 7,340,797 | B2 | 3/2008 | Theiss, Jr. et al. |
| 7,363,681 | B2 | 4/2008 | Durbin et al. |
| 7,367,081 | B2 | 5/2008 | O'Neal |
| 7,367,083 | B2 | 5/2008 | Barker et al. |
| 7,430,783 | B2 | 10/2008 | Williams et al. |
| 7,475,712 | B2 | 1/2009 | McDowell |
| 7,533,439 | B2 | 5/2009 | Theiss, Jr. et al. |
| 7,617,563 | B2 | 11/2009 | Hertrick et al. |
| 7,657,964 | B2 | 2/2010 | Parr et al. |
| 7,657,965 | B2 | 2/2010 | Scott et al. |
| 7,725,983 | B2 | 6/2010 | O'Neal |
| 7,725,985 | B2 | 6/2010 | Krebs |
| 7,752,705 | B2 | 7/2010 | McDowell et al. |
| 7,784,148 | B2 | 8/2010 | Lenkiwicz et al. |
| 7,862,623 | B1 | 1/2011 | Hansen et al. |
| 7,870,637 | B2 | 1/2011 | Parr et al. |
| 7,877,836 | B2 | 2/2011 | O'Neal |
| 7,966,690 | B2 | 6/2011 | Lenkiewicz |
| 7,979,951 | B2 | 7/2011 | Lenkiewicz et al. |
| 7,979,955 | B2 | 7/2011 | Lenkiewicz et al. |
| 8,122,562 | B2 | 2/2012 | Krebs |
| 8,146,200 | B2 | 4/2012 | Krebs et al. |
| 8,230,550 | B2 | 7/2012 | Krebs et al. |
| 8,505,155 | B2 | 8/2013 | Lenkiewicz |
| 8,621,708 | B2 | 1/2014 | Lenkiewicz et al. |
| 8,726,455 | B2 | 5/2014 | Kasper |
| 9,186,028 | B2 | 11/2015 | White et al. |
| 9,392,922 | B2 | 7/2016 | Lenkiewicz |
| 10,188,252 | B2 | 1/2019 | Nguyen et al. |
| 10,188,253 | B2 | 1/2019 | Miller |
| 10,238,260 | B2 | 3/2019 | Lenkiewicz et al. |
| 10,376,124 | B2 | 8/2019 | McDowell et al. |
| 2004/0134016 | A1 | 7/2004 | Kisela et al. |
| 2006/0123586 | A1 | 6/2006 | Wegelin et al. |
| 2007/0089610 | A1 | 4/2007 | Hayashi |
| 2009/0078284 | A1 | 3/2009 | McDowell et al. |
| 2010/0269286 | A1 | 10/2010 | Wegelin et al. |
| 2016/0037990 | A1 | 2/2016 | McDowell et al. |
| 2019/0117033 | A1 | 4/2019 | Miller |
| 2019/0142238 | A1 | 5/2019 | Nguyen |
| 2019/0159644 | A1 | 5/2019 | Lenkiewicz et al. |

SEPARATOR CONFIGURATION FOR A FLOOR CLEANER

CROSS-REFERENCE TO RELATED APPLICATIONS

This application claims priority to U.S. Provisional Patent Application No. 62/928,673, filed Oct. 31, 2019, the entire contents of which are hereby incorporated by reference herein.

BACKGROUND

The present disclosure relates to extractor cleaning machines, and more particularly, to separator configurations for extractor cleaning machines.

An extractor cleaning machine typically includes a separator for separating air from cleaning liquid prior to discharging the air.

SUMMARY

In one embodiment, the disclosure provides a cleaning machine having a housing, a fluid distributor that dispenses fluid, a supply tank connected to the housing to supply fluid to the fluid distributor, a suction nozzle that engages a surface to be cleaned, a suction source within the housing and in fluid communication with the suction nozzle to draw fluid into the suction nozzle from the surface to be cleaned, and a recovery tank selectively mounted on the housing and in fluid communication with the suction nozzle and the suction source to store fluid drawn through the suction nozzle. The recovery tank includes a container having a bottom wall and sidewalls projecting upwardly from the bottom wall thereby defining an open top, a cover connected to the open top of the container, and an air-liquid separator extending into the recovery tank from the open top. The air-liquid separator has a vertical sidewall, a lower wall extending laterally from a lower end of the vertical sidewall toward an adjacent sidewall of the sidewalls of the container. The vertical sidewall, the lower wall, and the adjacent sidewall define a separation chamber. The vertical sidewall includes a vertical rib extending outwardly from the vertical sidewall and into the separation chamber, and the separation chamber includes a dirty fluid inlet receiving fluid from the suction nozzle through the cover, and a dirty fluid outlet directing fluid from the separation chamber into the container.

In one embodiment, the disclosure provides a cleaning machine having a housing, a fluid distributor that dispenses fluid, a supply tank connected to the housing to supply fluid to the fluid distributor, and a suction nozzle that engages a surface to be cleaned. A suction source is positioned within the housing and is in fluid communication with the suction nozzle to draw fluid into the suction nozzle from the surface to be cleaned. A recovery tank is selectively mounted on the housing and in fluid communication with the suction nozzle and the suction source to store fluid drawn through the suction nozzle. The recovery tank includes a container having a bottom wall and sidewalls projecting upwardly from the bottom wall thereby defining an open top, a cover coupled to the open top of the container, and an air-liquid separator extending into the recovery tank from the open top. The air-liquid separator has a vertical sidewall, a lower wall extending laterally from the lower end of the vertical sidewall toward an adjacent sidewall of the sidewalls of the container. The vertical sidewall, the lower wall, and the adjacent sidewall define a separation chamber. The vertical sidewall includes a rib extending outwardly from the vertical sidewall and into the separation chamber. The separation chamber includes a dirty fluid inlet receiving fluid from the suction nozzle through the cover, a first dirty fluid outlet directing fluid from the separation chamber into the container, and a second dirty fluid outlet directing fluid from the separation chamber into the container. The rib is positioned between the first dirty fluid outlet and the second dirty fluid outlet.

In one embodiment, the disclosure provides a recovery tank for a cleaning machine having a housing, a fluid distributor that dispenses fluid, a supply tank connected to the housing to supply fluid to the fluid distributor. A suction nozzle engages a surface to be cleaned, and a suction source is positioned within the housing. The suction source is in fluid communication with the suction nozzle to draw fluid into the suction nozzle from the surface to be cleaned. The recovery tank is mounted on the housing and in to be fluid communication with the suction nozzle and the suction source. The recovery tank stores fluid drawn through the suction nozzle and includes a container having a bottom wall and sidewalls projecting upwardly from the bottom wall thereby to define an open top. A cover is connected to the open top of the container. An air-liquid separator extending into the recovery tank from the open top. The air-liquid separator has a vertical sidewall, a lower wall extending laterally from the lower end of the vertical sidewall toward an adjacent sidewall of the sidewalls of the container. The vertical sidewall, the lower wall, and the adjacent sidewall define a separation chamber. The vertical sidewall includes a vertical rib extending outwardly from the vertical sidewall and into the separation chamber. The separation chamber includes a dirty fluid inlet that receives fluid from the suction nozzle through the cover, a first dirty fluid outlet that directs fluid from the separation chamber into the container, and a second dirty fluid outlet that directs fluid from the separation chamber into the container. The vertical rib is positioned between the first dirty fluid outlet and the second dirty fluid outlet.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
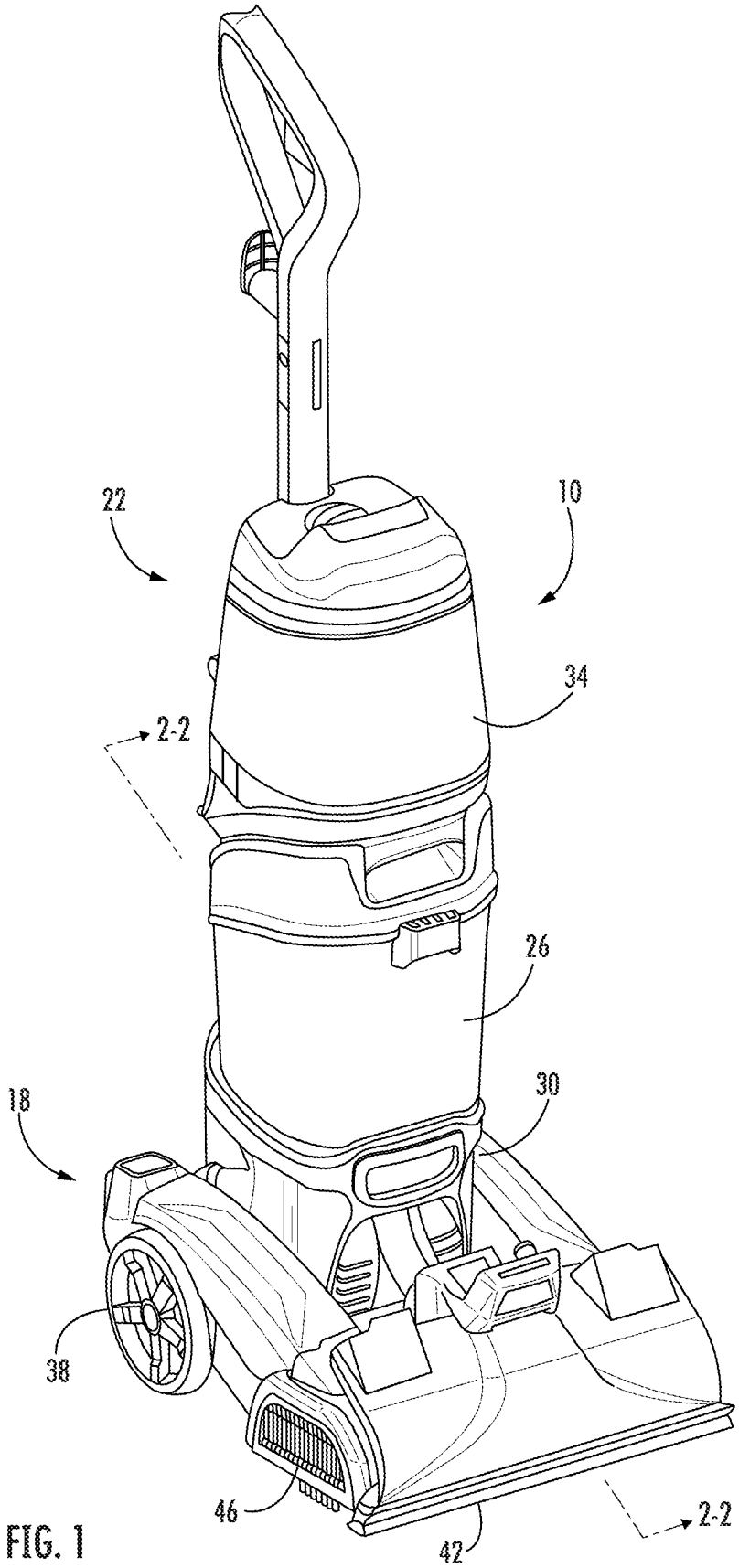
FIG. 1 is a perspective view of an extractor cleaning machine according to some embodiments of the invention.
Figure 2:
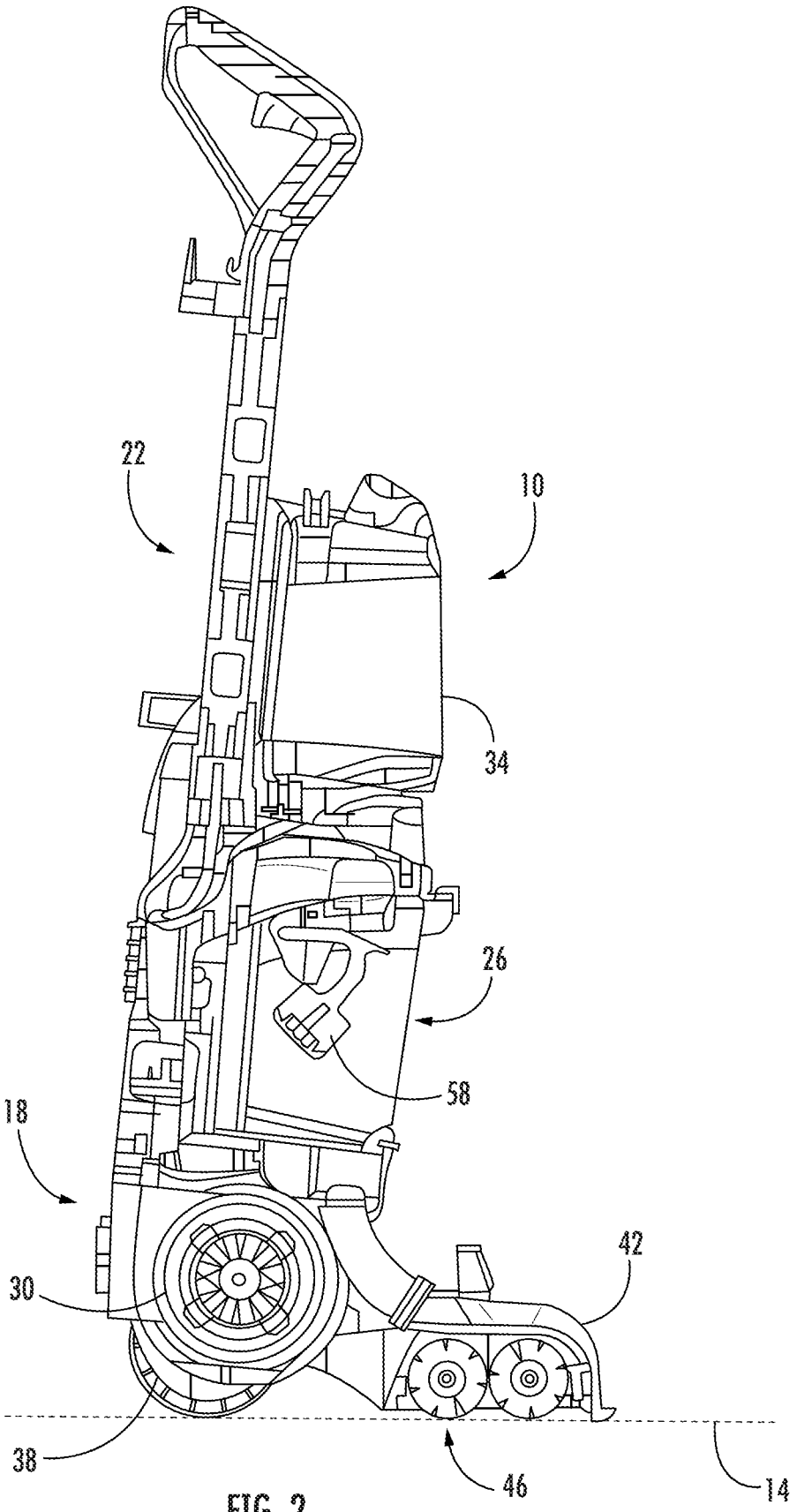
FIG. 2 is a cross-sectional view taken along line 2-2 of FIG. 1.

FIGS. 1 and 2 illustrate an extractor cleaning machine 10 (hereinafter referred "extractor"). In the illustrated embodiment, the extractor 10 is an upright extractor operable to clean a surface 14, such as, for example, a floor (FIG. 2). In some embodiments, the extractor 10 may be adapted to clean a variety of surfaces, such as carpets, hardwood floors, tiles, or the like. A cleaning fluid (e.g., water, detergent, or a mixture of water and detergent) is dispensed onto the surface to clean the surface 14. The extractor 10 then draws the cleaning fluid and dirt from the surface, leaving the surface relatively clean.

The illustrated extractor 10 includes a base 18, a body 22 coupled to the base 18, a recovery tank 26 coupled to the body 22, a suction source 30, a fluid distribution system (not shown), a supply tank assembly 34 coupled to the body 22, two wheels 38, a suction nozzle 42 and a brush assembly 46. The recovery tank 26 includes an air-liquid separator 26 configured to separate air from the cleaning fluid drawn from the surface. The air-liquid separator 62 includes a rib 90 downstream from the inlet to the recovery tank 26 to direct a first flow path on a first side of the rib 90 and direct a second flow path on a second side of the rib 90 as described below. Other extractors within the scope of the disclosure may include a different type of base, such as including the recovery tank and or supply tank coupled to the base. In addition, other extractors may be different than the illustrated upright configuration. For example, other embodiments of the extractor may include hand held or portable extractors also known as spot cleaners.

The base 18 is movable along the surface 14 to be cleaned. In the illustrated embodiment, two wheels 38 are coupled to the base 18 to facilitate movement of the base 18 along the surface 14. In other embodiments more than two wheels can be utilized. In the illustrated embodiment, the wheels 38 are idle wheels. In other embodiments, one or both of the wheels 38 may be driven wheels.

The illustrated body 22 includes a housing and is pivotally coupled to and extends from the base 18. The body 22 is pivotable or tiltable relative to the base 18 from a generally vertical, or upright, storage position to one or more non-vertical, or inclined, operating positions. Pivoting the body 22 to an operating position facilitates moving the base 18 along the surface 14.

The recovery tank 26 is in fluid communication with the suction nozzle 42 and the suction source 30. The recovery tank 26 is configured to store cleaning fluid and any dirt extracted from the surface 14 through the suction nozzle 42. The suction source 30 is connected to the body 22 and is in fluid communication with the suction nozzle 42. The suction source 30 draws fluid into the suction nozzle 42 from the surface 14 to be cleaned.

The supply tank assembly 34 is configured to store cleaning fluid to be distributed by the extractor 10 onto the surface 14. The fluid distribution system is in fluid communication with the supply tank assembly 34 to draw cleaning fluid from the supply tank assembly 34 and distribute the fluid to the surface 14 through a distribution nozzle 42. In some embodiments, the fluid distribution system may include a pump that propels the cleaning fluid to the surface 14. In another embodiment, gravity moves the cleaning fluid through the distribution nozzle 42 to the surface 14. The body 22 supports one or more actuators that control cleaning fluid delivery from the supply tank assembly 34 through a distributor and a distribution nozzle and onto the surface 14.

Figure 3:
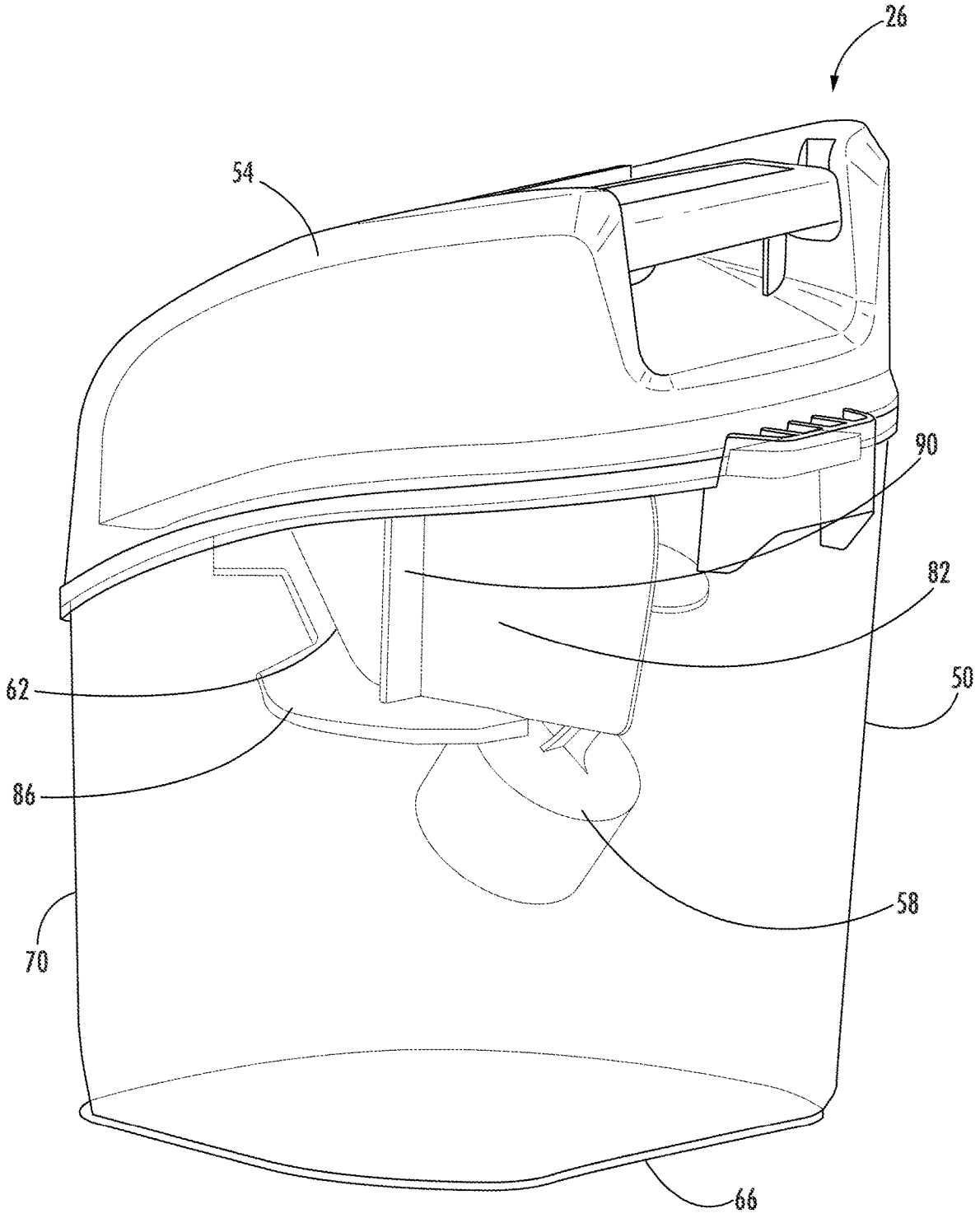
FIG. 3 is a perspective view of a recovery tank of the extractor cleaning machine of FIG. 1.

FIG. 3 illustrates the recovery tank 26 in greater detail. The recovery tank 26 is selectively mounted to the body 22 and includes a container 50, a cover 54, a float valve 58, and the air-liquid separator 62 (hereinafter "separator"). The container 50 has a bottom wall 66 and sidewalls 70 projecting upward from the bottom wall 66 toward an open top. The illustrated bottom wall 66 is substantially rectangular and the sidewalls 70 extend around an entire perimeter of the bottom wall 66 and extend upward therefrom. In some embodiments, the sidewalls 70 are substantially planar, whereas in other embodiments, the sidewalls 70 are curved or slightly curved. The cover 54 is removably connected to the open top of the container 50 to close the open top of the container 50 while the cover 54 is installed.

Figure 4:
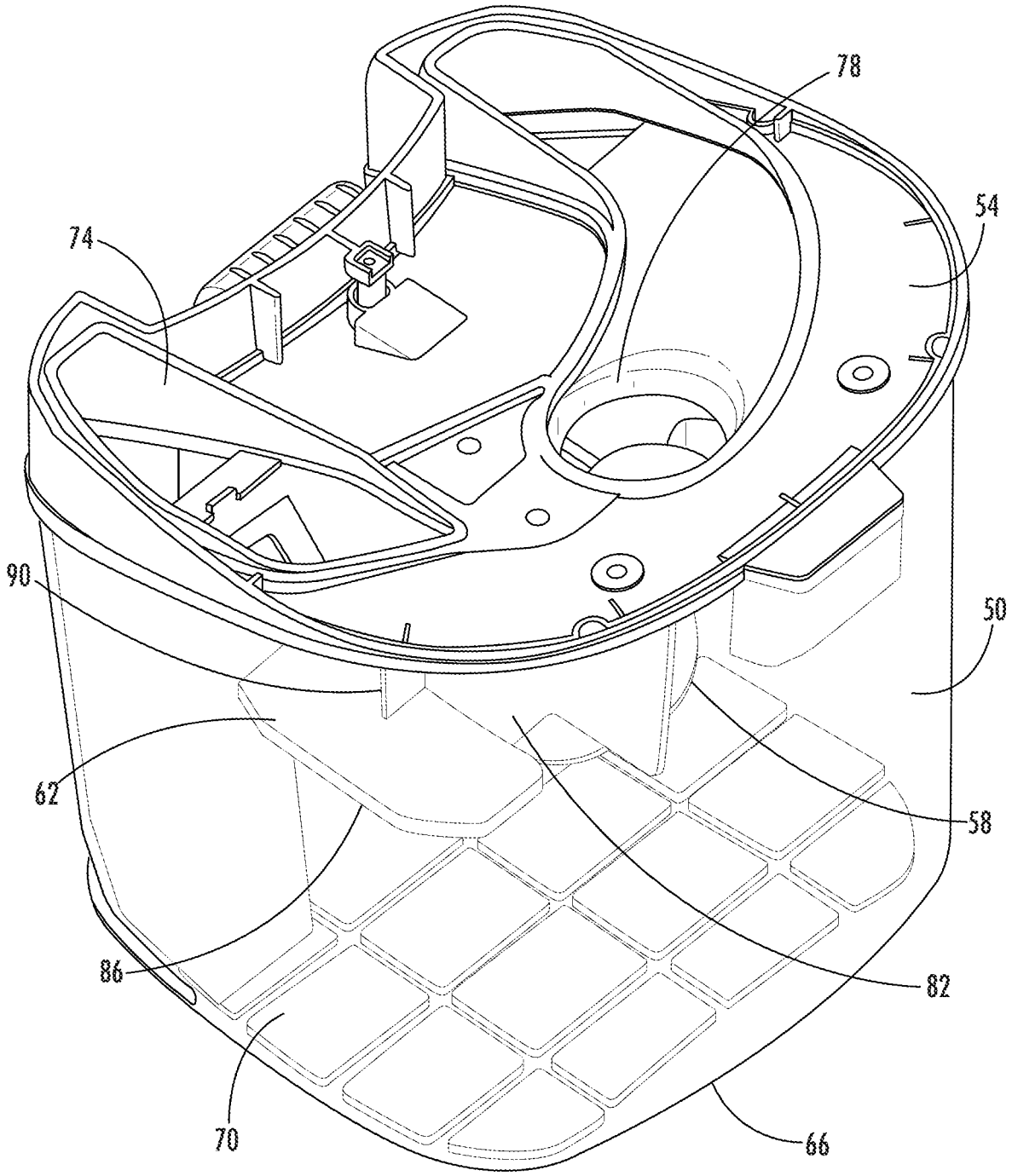
FIG. 4 is a perspective view of the recovery tank with a portion of a cover removed.
Figure 5:
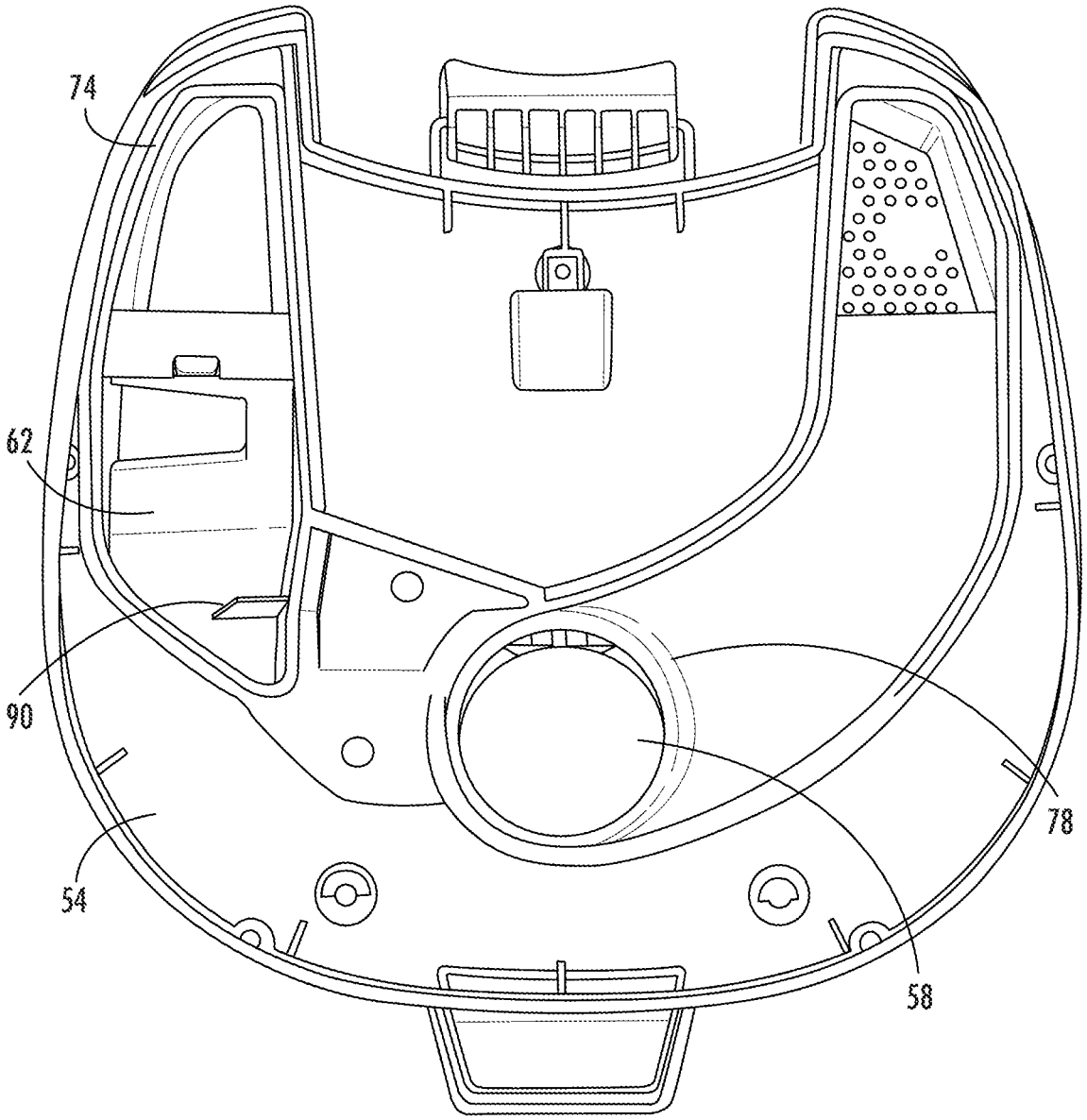
FIG. 5 is a top view of the recovery tank with a portion of the cover removed.

With reference to FIGS. 4 and 5, the cover 54 forms a dirty fluid inlet 74, and a clean air outlet 78. The dirty fluid inlet 74 is positioned near the separator 62. The dirty fluid inlet 74 permits dirty fluid extracted from the floor 14 to be cleaned by the suction nozzle 42 to flow into the container 50. The container 50 retains the dirty fluid until a user detaches the recovery tank 26 from the body 22 and empties the container 50.

The clean air outlet 78 permits clean air to flow out of the container 50. The clean air outlet 78 is spaced from the separator 62. The float valve 58 selectively covers the clean air outlet 78 to selectively permit clean air to flow through the clean air outlet 78. When the level of dirty fluid in the container 50 is below a set level, the float valve 58 permits air flow through the clean air outlet 78. When the level of dirty fluid in the container 50 is above the set level, the float valve 58 closes the clean air outlet 78 to inhibit air flow through the clean air outlet 78.

Figure 6:
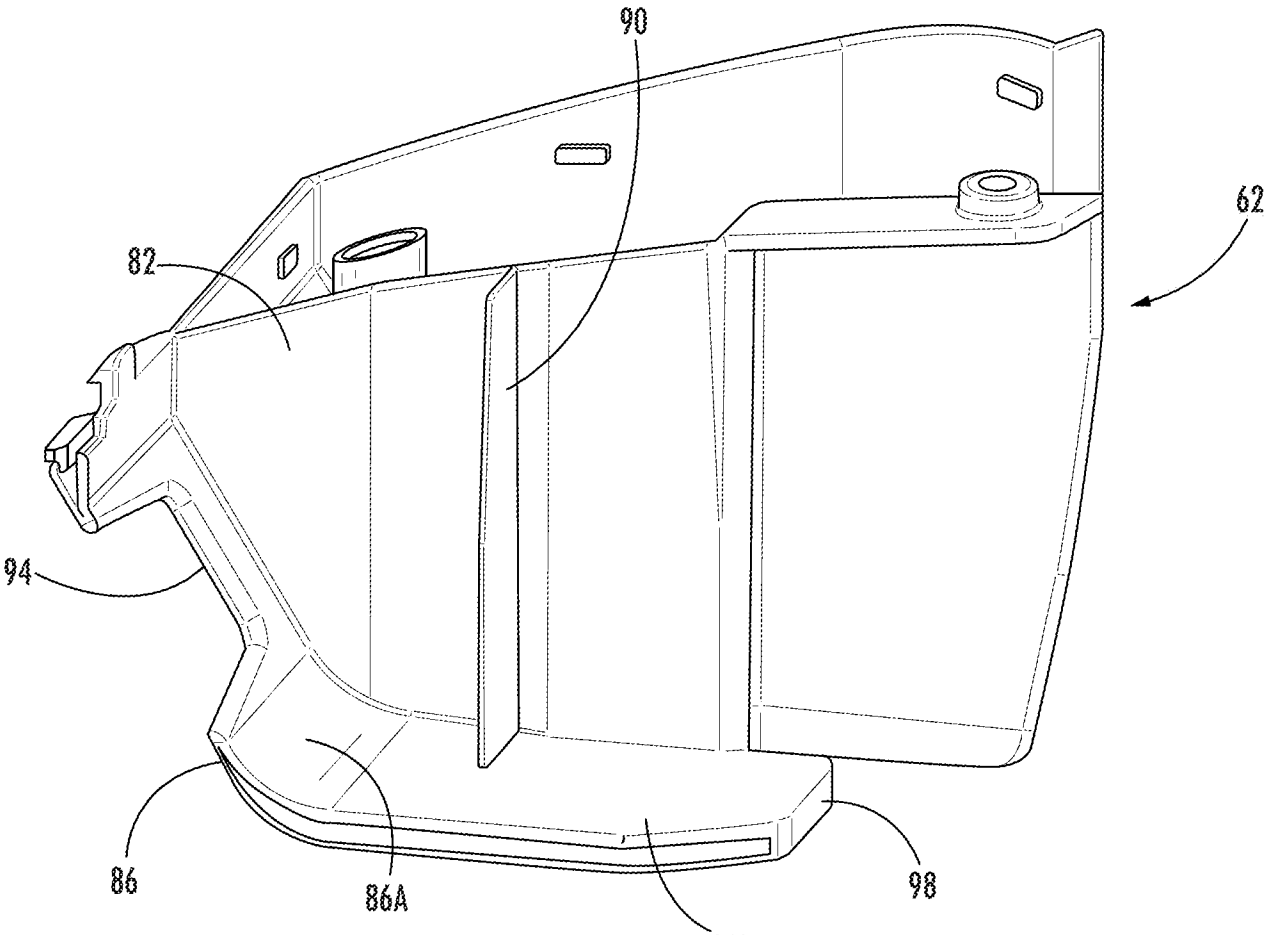
FIG. 6 is a perspective view of an air-liquid separator of the recovery tank.

FIG. 6 illustrates the separator 62 removed from the recovery tank 26. The separator 62 has a vertical sidewall 82, a lower wall 86 and a rib 90. The vertical sidewall 82 extends downwardly into the recovery tank 26 from the open top of the recovery tank 26. The vertical sidewall 82 is substantially parallel to the adjacent sidewall 70 of the container 50. The vertical sidewall 82 extends into the recovery tank 26 from the open top of the recovery tank 26 and ends at a location spaced above the bottom wall 66 of the container 50. The dirty fluid inlet 74 is positioned on a first side of the vertical sidewall 82 and the clean air outlet 78 is positioned on a second side of the vertical sidewall 82, opposite the first side. The float valve 58 is positioned on the second side of the vertical sidewall 82.

The lower wall 86 extends laterally from a lower end of the vertical sidewall 82 toward an adjacent sidewall 70 of the container 50. The lower wall 86 includes a first portion 86A that extends from the dirty fluid inlet 74 to the rib 90, and a second portion 86B that extends from the rib 90 toward a lower wall end 98 proximate the adjacent sidewall of the container 50. The first portion includes an aperture 94. A first dirty fluid outlet is formed by the aperture 94. In the illustrated embodiment, the aperture 94 is bounded by the adjacent sidewall of the container 50. The lower wall end 98 bounded by the vertical sidewall 82 and the adjacent sidewall of the container 50 form a second dirty fluid outlet.

The vertical sidewall 82, the lower wall 86, and the adjacent sidewall of the container 50 define a separation chamber. The separation chamber receives dirty fluid through the dirty fluid inlet 74 from the suction nozzle 42 through the cover 54. The separation chamber discharges fluid out of the first dirty fluid outlet (at aperture 94) and the second dirty fluid outlet (at lower wall end 98) into the container 50.

The rib 90 extends laterally outward from the vertical sidewall 82 toward the adjacent sidewall 70 of the container 50 and into the separation chamber. In some embodiments, the rib 90 extends horizontally outward from the vertical sidewall 82 and vertically upward from the lower wall 86. The rib 90 is positioned between the first dirty fluid outlet and the second dirty fluid outlet. The rib 90 includes a first side facing toward the aperture 94 and a second side facing toward the lower wall end 98.

Figure 7:
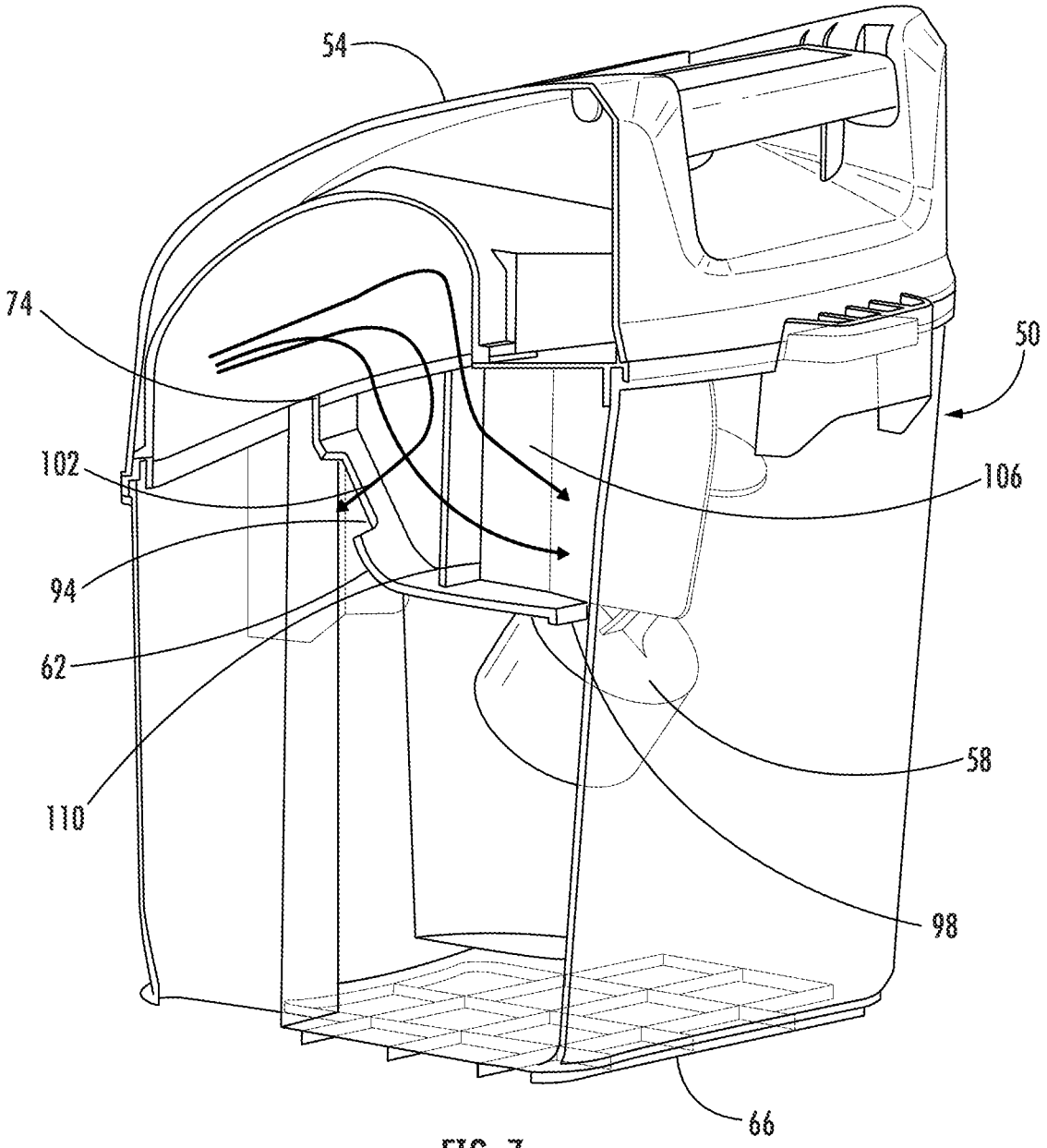
FIG. 7 is a perspective view of a recovery tank of the extractor cleaning machine of FIG. 1 with a portion of the recovery tank removed.
Figure 8:
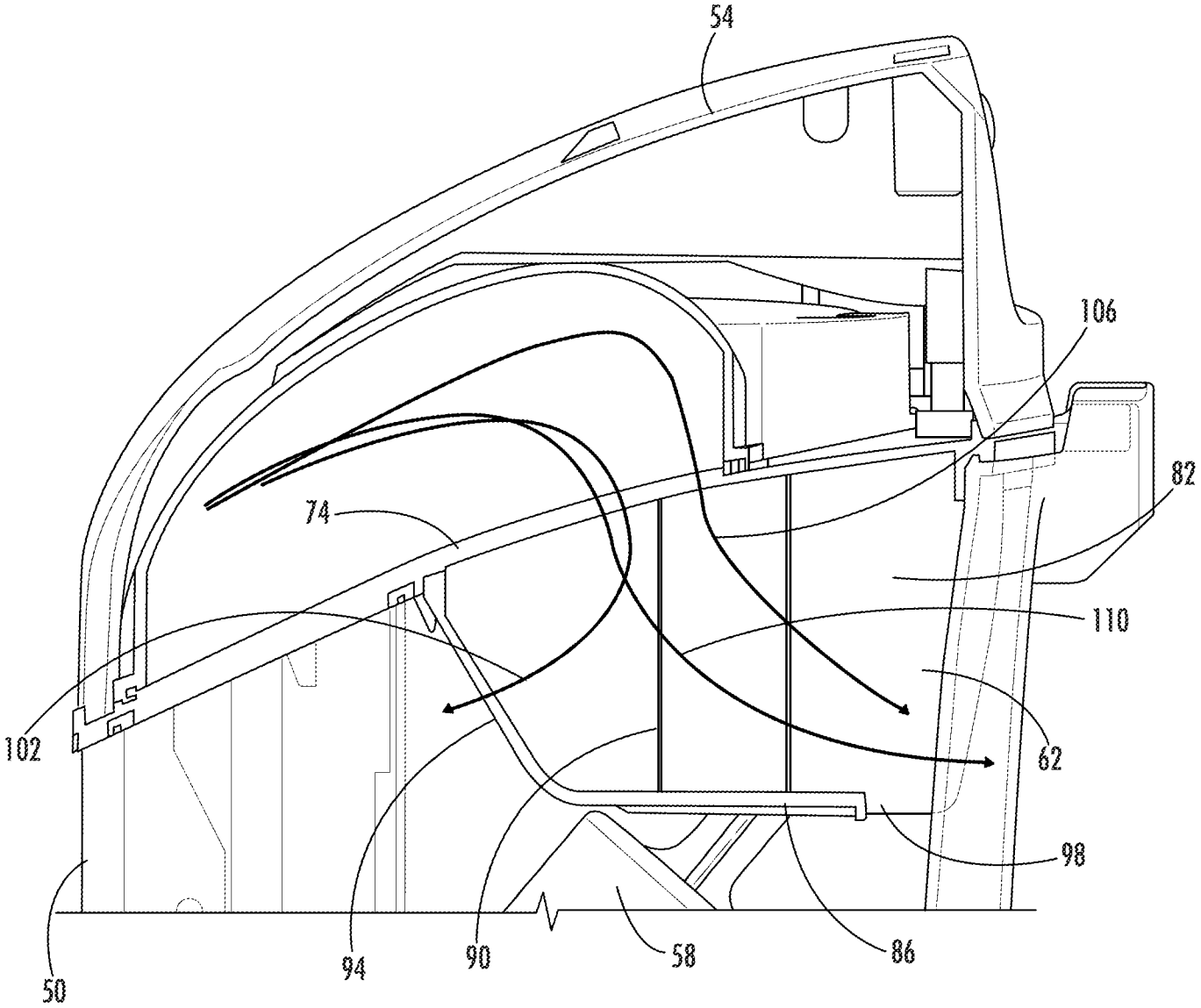
FIG. 8 is a close up view of a portion of FIG. 7.

As shown in FIGS. 7 and 8, the rib 90 is configured to separate dirty fluid into a first flow path 102, a second flow path 106 and a third flow path 110. Fluid flowing along the first flow path 102 flows from the dirty fluid inlet 74, contacts the first side of the rib 90 and flows out of the first dirty fluid outlet (at aperture 94). Fluid flowing along the second flow path 106 flows from the dirty fluid inlet 74 above the rib 90, contacts the second side of the rib 90 and flows out of the second dirty fluid outlet (at lower wall end 98). Fluid flowing along the third flow path 110 flows from the dirty fluid inlet 74 between the rib 90 and the adjacent sidewall 70 of the container 50 and out of the second fluid outlet (at lower wall end 98).

The rib 90 diverts dirty fluid flow from the dirty fluid inlet 74 into the first flow path 102, the second flow path 106 and the third flow path 110. The dirty fluid is slowed down as it enters the container 50 such that fluid settles at a bottom of the container 50 and air is permitted to exit the clean air outlet 78.

What is claimed is:

1. A cleaning machine comprising:

a housing;

a fluid distributor configured to dispense fluid;

a supply tank coupled to the housing and configured to supply fluid to the fluid distributor;

a suction nozzle configured to engage a surface to be cleaned;

a suction source within the housing and in fluid communication with the suction nozzle, the suction source operable to draw fluid into the suction nozzle from the surface to be cleaned;

a recovery tank selectively mounted on the housing and in fluid communication with the suction nozzle and the suction source, the recovery tank configured to store fluid drawn through the suction nozzle, the recovery tank including a container having a bottom wall and sidewalls projecting upwardly from the bottom wall thereby defining an open top, a cover coupled to the open top of the container, and an air-liquid separator extending into the recovery tank from the open top, the air-liquid separator having a vertical sidewall, a lower wall extending laterally from a lower end of the vertical sidewall toward an adjacent sidewall of the sidewalls of the container, wherein the vertical sidewall, the lower wall, and the adjacent sidewall define a separation chamber, wherein the vertical sidewall includes a vertical rib extending outwardly from the vertical sidewall and into the separation chamber, and wherein the separation chamber includes a dirty fluid inlet receiving fluid from the suction nozzle through the cover, and a dirty fluid outlet directing fluid from the separation chamber into the container.

2. The cleaning machine of claim 1, wherein the vertical rib extends horizontally outward from the vertical sidewall to direct a first flow path on a first side of the vertical rib and direct a second flow path on a second side of the vertical rib.

3. The cleaning machine of claim 2, wherein dirty fluid entering the dirty fluid inlet is directed toward the vertical rib and the vertical rib is configured to divert the dirty fluid into either the first flow path or the second flow path, the dirty fluid inlet being positioned on the first side of the vertical rib.

4. The cleaning machine of claim 2, wherein the dirty fluid outlet is a first dirty fluid outlet positioned on the first side of the vertical rib, the air-liquid separator further comprises a second dirty fluid outlet positioned on the second side of the vertical rib, the first dirty fluid outlet and the second dirty fluid outlet are configured to direct fluid from the separation chamber into the container.

5. The cleaning machine of claim 4, wherein the cover forms a clean air outlet fluidly connected to the container, the dirty fluid inlet positioned on a first side of the vertical sidewall and the clean air outlet positioned on a second side of the vertical sidewall, the first side being opposite the second side.

6. The cleaning machine of claim 5, further comprising a float valve configured to selectively cover the clean air outlet to selectively permit clean air to exit the clean air outlet and to inhibit dirty fluid from exiting the clean air outlet, the float valve being positioned on the second side of the vertical sidewall.

7. The cleaning machine of claim 4, wherein the vertical rib is spaced from the adjacent sidewall of the container to form a third flow path between the vertical rib and the adjacent sidewall of the container from the first side of the vertical rib to the second side of the vertical rib.

8. A cleaning machine comprising:

a housing;

a fluid distributor configured to dispense fluid;

a supply tank coupled to the housing and configured to supply fluid to the fluid distributor;

a suction nozzle configured to engage a surface to be cleaned;

a suction source within the housing and in fluid communication with the suction nozzle, the suction source operable to draw fluid into the suction nozzle from the surface to be cleaned;

a recovery tank selectively mounted on the housing and in fluid communication with the suction nozzle and the suction source, the recovery tank configured to store fluid drawn through the suction nozzle, the recovery tank including a container having a bottom wall and sidewalls projecting upwardly from the bottom wall thereby defining an open top, a cover coupled to the open top of the container, and an air-liquid separator extending into the recovery tank from the open top, the air-liquid separator having a vertical sidewall, a lower wall extending laterally from the lower end of the vertical sidewall toward an adjacent sidewall of the sidewalls of the container, wherein the vertical sidewall, the lower wall, and the adjacent sidewall define a separation chamber, wherein the vertical sidewall includes a rib extending outwardly from the vertical sidewall and into the separation chamber, wherein the separation chamber includes a dirty fluid inlet receiving fluid from the suction nozzle through the cover, a first dirty fluid outlet directing fluid from the separation chamber into the container, and a second dirty fluid outlet directing fluid from the separation chamber into the container, the rib positioned between the first dirty fluid outlet and the second dirty fluid outlet.

9. The cleaning machine of claim 8, wherein the rib is a vertical rib and extends laterally outward from the vertical sidewall and into the separation chamber, and wherein the rib is configured to separate dirty fluid into a first flow path and a second flow path, the first flow path leading to the first outlet and the second flow path leading to the second outlet.

10. The cleaning machine of claim 8, wherein the adjacent sidewall of the sidewalls of the container is a vertical adjacent sidewall extending substantially parallel to the vertical sidewall of the air-liquid separator, and wherein the rib extends laterally from the vertical sidewall toward the vertical adjacent sidewall.

11. The cleaning machine of claim 8, wherein the lower wall includes a first portion and a second portion, the first portion extending from the dirty fluid inlet to the rib and defining a recess, the first dirty fluid outlet at least partially formed by the recess, the second portion extending from the rib toward a lower wall end proximate one of the sidewalls of the container, the second dirty fluid outlet formed at least partially between the lower wall end and the one of the sidewalls of the container.

12. The cleaning machine of claim 11, wherein the cover forms a clean air outlet fluidly connected to the container, the dirty fluid inlet positioned on a first side of the of the vertical sidewall and the clean air outlet positioned on a second side of the vertical sidewall, the first side being opposite the second side.

13. The cleaning machine of claim 12, further comprising a float valve configured to selectively cover the clean air outlet to selectively permit clean air to exit the clean air outlet and to inhibit dirty fluid from exiting the clean air outlet, the float valve being positioned on the second side of the vertical sidewall.

14. The cleaning machine of claim 8, wherein the vertical rib is spaced from the adjacent sidewall of the container to form a third flow path between the vertical rib and the adjacent sidewall of the container from the first side of the vertical rib to the second side of the vertical rib.

15. A recovery tank for a cleaning machine having a housing, a fluid distributor configured to dispense fluid, a supply tank coupled to the housing and configured to supply fluid to the fluid distributor, a suction nozzle configured to engage a surface to be cleaned, and a suction source within the housing and in fluid communication with the suction nozzle, the suction source operable to draw fluid into the suction nozzle from the surface to be cleaned, the recovery tank configured to be mounted on the housing and in to be fluid communication with the suction nozzle and the suction source, the recovery tank configured to store fluid drawn through the suction nozzle, the recovery tank comprising:

a container having a bottom wall and sidewalls projecting upwardly from the bottom wall thereby defining an open top;

a cover coupled to the open top of the container; and an air-liquid separator extending into the recovery tank from the open top, the air-liquid separator having a vertical sidewall, a lower wall extending laterally from the lower end of the vertical sidewall toward an adjacent sidewall of the sidewalls of the container, wherein the vertical sidewall, the lower wall, and the adjacent sidewall define a separation chamber, wherein the vertical sidewall includes a vertical rib extending outwardly from the vertical sidewall and into the separation chamber, and wherein the separation chamber includes a dirty fluid inlet configured to receive fluid from the suction nozzle through the cover, a first dirty fluid outlet configured to direct fluid from the separation chamber into the container, and a second dirty fluid outlet configured to direct fluid from the separation chamber into the container, the vertical rib positioned between the first dirty fluid outlet and the second dirty fluid outlet.

16. The recovery tank of claim 15, wherein a first portion of the dirty fluid is directed by the vertical rib to the first outlet, and a second portion of the dirty fluid flows above the vertical rib to the second outlet, wherein the rib extends laterally from the vertical sidewall toward the vertical adjacent sidewall, and wherein the vertical rib is configured to separate dirty fluid into a first flow path and a second flow path, the first flow path leading to the first outlet and the second flow path leading to the second outlet.

17. The recovery tank of claim 15, wherein the lower wall includes a first portion and a second portion, the first portion extending from the dirty fluid inlet to the rib and defining a recess, the first dirty fluid outlet at least partially formed by the recess, the second portion extending from the rib toward a lower wall end proximate one of the sidewalls of the container, the second dirty fluid outlet formed at least partially between the lower wall end and the one of the sidewalls of the container.

18. The recovery tank of claim 15, wherein the cover forms a clean air outlet fluidly connected to the container, the dirty fluid inlet positioned on a first side of the of the vertical sidewall and the clean air outlet positioned on a second side of the vertical sidewall, the first side being opposite the second side.

19. The recovery tank of claim 18, further comprising a float valve configured to selectively cover the clean air outlet to selectively permit clean air to exit the clean air outlet and to inhibit dirty fluid from exiting the clean air outlet, the float valve being positioned on the second side of the vertical sidewall.

20. The recovery tank of claim 15, wherein the vertical rib is spaced from the adjacent sidewall of the container to form a third flow path between the vertical rib and the adjacent sidewall of the container from the first side of the vertical rib to the second side of the vertical rib.

* * * * *